US009300052B2

(12) United States Patent
Schweppe

(10) Patent No.: US 9,300,052 B2
(45) Date of Patent: Mar. 29, 2016

(54) ADJUSTABLE ANTENNA SYSTEM

(71) Applicant: Robert F. Schweppe, Lake Forest, IL (US)

(72) Inventor: Robert F. Schweppe, Lake Forest, IL (US)

( * ) Notice: Subject to any disclaimer, the term of this patent is extended or adjusted under 35 U.S.C. 154(b) by 468 days.

(21) Appl. No.: 13/707,879

(22) Filed: Dec. 7, 2012

(65) Prior Publication Data

US 2013/0147671 A1 Jun. 13, 2013

Related U.S. Application Data

(60) Provisional application No. 61/568,766, filed on Dec. 9, 2011.

(51) Int. Cl.
*H01Q 1/12* (2006.01)
*H01Q 9/14* (2006.01)

(52) U.S. Cl.
CPC ..... *H01Q 9/145* (2013.01)

(58) Field of Classification Search
CPC ..... H01Q 9/145
USPC ..... 343/723, 821, 901, 903, 877
See application file for complete search history.

(56) References Cited

U.S. PATENT DOCUMENTS

| | | | | |
|---|---|---|---|---|
| 1,438,290 | A | 12/1922 | Beakes | |
| 3,268,898 | A * | 8/1966 | Colony | 343/723 |
| 3,950,756 | A * | 4/1976 | Tisler | 343/766 |
| 4,353,515 | A * | 10/1982 | Weaver et al. | 242/423.1 |
| 4,750,001 | A * | 6/1988 | Grose et al. | 343/877 |
| 5,221,930 | A | 6/1993 | Scott | |
| 5,835,070 | A | 11/1998 | Scaraglino | |
| 5,865,390 | A | 2/1999 | Iveges | |
| 6,335,708 | B1 * | 1/2002 | Coleman | 343/877 |
| 6,677,914 | B2 | 1/2004 | Mertel | |
| 7,463,211 | B2 | 12/2008 | Mertel et al. | |
| 7,581,368 | B1 * | 9/2009 | Bison | 53/399 |
| 7,597,179 | B2 | 10/2009 | Chou | |
| RE42,087 | E | 2/2011 | Mertel | |
| 2012/0178997 | A1 * | 7/2012 | Tydlaska et al. | 600/186 |

OTHER PUBLICATIONS

SteppIR, "Radial Systems for Elevated and Ground mounted Vertical Antennas".
Freescale Semiconductor, Inc., "Compact Integrated Antennas" Application Note, Jul. 2006.
SteppIR, Advertisement: "Introducing the New CrankIR Vertical," Jan. 2013, QST.

* cited by examiner

*Primary Examiner* — Hoanganh Le
(74) *Attorney, Agent, or Firm* — Leydig, Voit & Mayer, Ltd

(57) ABSTRACT

An adjustable antenna system for transmission and/or reception of electromagnetic waves enables adjustment of the length of an antenna cable for adjustably tuning one or more operating parameters of the antenna. The antenna system can include a spindle frame that can support a first spool and a second spool that are rotatably mountable on the spindle frame. Wrapped around the first spool can be a length of antenna cable and wrapped around the second spool can be a length of non-conducting line. The distal ends of the cable and line can be connected so that as spools are selectively rotated independently or dependently, the relative lengths of the cable and line are changed. The antenna system can further include a transmission bus partially disposed along the spindle frame to establish communication between the antenna cable and a connector for connecting to a transmitter/receiver associated with the antenna system.

18 Claims, 12 Drawing Sheets

ADJUSTABLE ANTENNA SYSTEM

CROSS-REFERENCE TO RELATED APPLICATIONS

This patent application claims the benefit of U.S. Provisional Patent Application No. 61/568,766, filed Dec. 9, 2011, which is incorporated by reference.

BACKGROUND

Antennas are widely used in many applications to send and receive electro-magnetic signals, typically radio frequency (RF) signals, for communication purposes. There exist many different antenna designs and configurations that are intended for specific purposes or for particular operational parameters such as intended operational frequency, directionality, radiation pattern, efficiency or gain, and other parameters. For example, one consideration in antenna design is whether the antenna is intended for use at a fixed location, such as a television transmitter or a cell-phone tower, or whether it will be portable for temporary use in various different locations, such as for use with portable radios. If the antenna is intended to be portable, its design should facilitate compactness, transportability, and ease of set-up and break down.

As will be appreciated by those of skill in the art, antennas typically consist of a conductive material with electrons moving therein in accordance with an electrical signal causing the antenna to radiate a corresponding electromagnetic signal. Likewise, when an electromagnetic signal impinges upon the antenna, it will convert the electromagnetic signal to an electrical signal for further processing. It is also well known that antennas tend to transmit and receive signals optimally at specific frequencies and/or wavelengths that are often a function of the length of the antenna. For these reasons, it is necessary to tune the antenna and associated system to operate at different frequencies. Tuning can be accomplished in various ways, such as by adjusting the reactance, i.e., the inductance and/or capacitance, of the associated radio components, i.e., the transmitter and receiver, or by adjusting the length of the antenna. This type of tuning may be referred to as impedance matching whereby communication of the signals between the antenna and the transmission line to the other radio components is optimized.

Occasionally, the foregoing considerations may compete with each other. For instance, the complex design and interoperation of components needed to tune an antenna, especially by adjusting the antenna length, may compete with simplifying the antenna design to facilitate portability and ease of use. Accordingly, the present disclosure is intended to respond to the competing considerations of portability and tuning of an antenna.

BRIEF SUMMARY

The disclosure describes a portable, adjustable antenna system for use by amateur radio operators, emergency personal and the like. The antenna system includes a spindle frame having a rod-like axle extending therefrom and first and second spools that can be rotatably mounted and demounted to the spindle frame. Wrapped around one of the spools can be a conductive antenna cable and wrapped around the other spool can be a non-conductive line which can be connected together to form a loop with respect to the antenna system. The spools may be selectively coupled for selective independent and dependent rotation with respect to each other. In this manner, if the cable antenna is wound-in thereby decreasing its effective length, the non-conducting line can unwind increasing its length and maintaining the overall length of the loop. As can be appreciated, adjusting the effective length of the antenna cable enables the antenna system to be tuned to specific frequencies and/or wavelengths. In other embodiments, to provide a dipole antenna configuration, the second spool can include another antenna cable instead of the non-conductive line.

An advantage of the present disclosure is that it provides a compact and easy to use antenna system that can be adjusted or tuned to optimally transmit and receive at different frequencies and/or wavelengths of the electromagnetic spectrum. A related advantage is that the orientation and/or selective rotation of the first and second spools on the spindle frame enables an operator to manipulate the speed and manner at which the antenna cable can be extended or retracted to adjust the tuning. Another advantage is that the versatile design enables the antenna system to be utilized in different configurations such as a monopole or dipole antenna, or to operate at different wavelengths or fractions of wavelengths. These and other features and advantages of the disclosure will be apparent from the following detailed description and the accompanying drawings.

DETAILED DESCRIPTION

Figure 1:
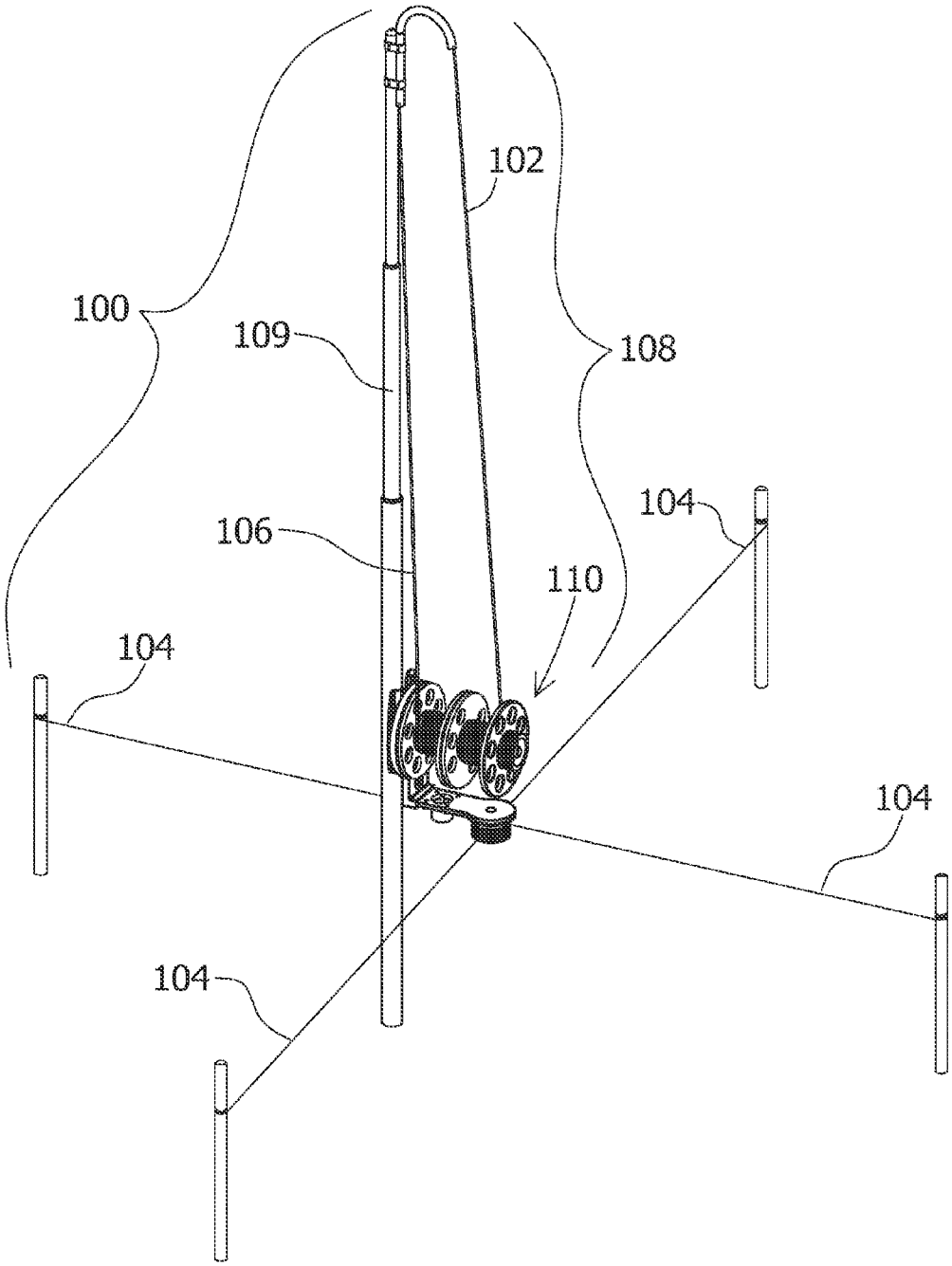
FIG. 1 is a perspective view of an adjustable antenna system according to the present disclosure set up for operation and use in a remote location.

Now referring to FIG. 1, wherein like reference numbers refer to like elements, there is illustrated an adjustable antenna system 100 set-up to transmit and receive RF signals in a remote location such as an open field. The antenna system can be used for any suitable purpose such as for Ham radio operation for recreational purposes or otherwise, emergency communications, military operations or the like. In addition to transmitting and receiving RF signals for communication between humans, the antenna system can be used for directly communicating with other RF devices and systems for digital communications, location, identification, tracking and any other suitable purpose. To facilitate its use, the antenna system is designed to be both portable and adjustable for tuning to particular frequencies and/or wavelengths.

In the illustrated embodiment, the antenna system is configured as a vertical mono-pole antenna including a vertically oriented conductive antenna cable 102 and a plurality of conductive radials 104 extending relatively horizontally with respect to the antenna cable 102. The vertical orientation of the antenna cable 102 can be supported by a pole 109, tree branch, or the like. As will be familiar to those of skill in the art, the vertical antenna cable 102 will function as one-half of the antenna transmitting and receiving signals in a vertical radiation pattern while the plurality of horizontal radials 104 will form a ground plane or counterpoise that simulates the other half of the antenna. The horizontal radials may form an elevated ground plane wherein the radials are supported above the ground by stakes or the like. The vertical monopole arrangement of the antenna system 100 can be configured to operate at any suitable wavelength ratio such a ½, ¼ or the like. Moreover, in other embodiments, the antenna system 100 can be configured to operate as a horizontal monopole antenna, or as dipole antenna including vertical dipole, sloping dipole or horizontal dipole.

To tune the antenna for operation at a particular frequency and/or wavelength, the antenna system 100 is adapted to enable adjustment of the length or distance of the conductive antenna cable 102. For example, the antenna system 100 includes a spindle assembly 110 from which the conductive antenna cable 102 adjustably extends. Also extending adjustably from the spindle assembly 110 is a non-conductive line 106 which, at its distal end, connects with the distal end of the antenna cable 102 such that the two form a loop extending from and returning to the spindle assembly. Adjusting the relative length of extension between the conductive antenna cable 102 and the non-conductive line 106 effectively alters the length of the antenna and therefore the frequency to which the antenna system 100 optimally operates.

Figure 2:
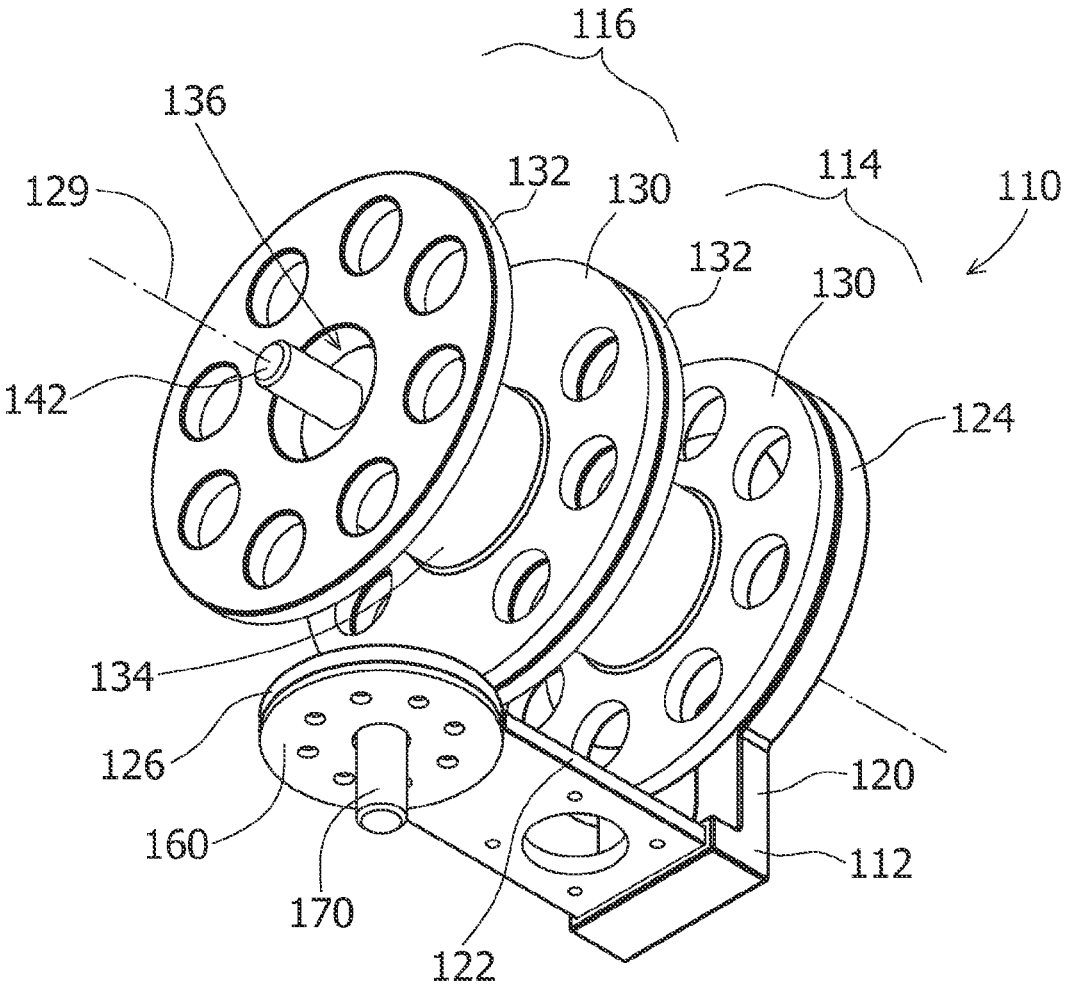
FIG. 2 is a perspective view of the antenna system assembled together including a spindle frame and first and second spools rotatably mounted to the spindle frame for winding and unwinding a conductive antenna cable (not shown).
Figure 3:
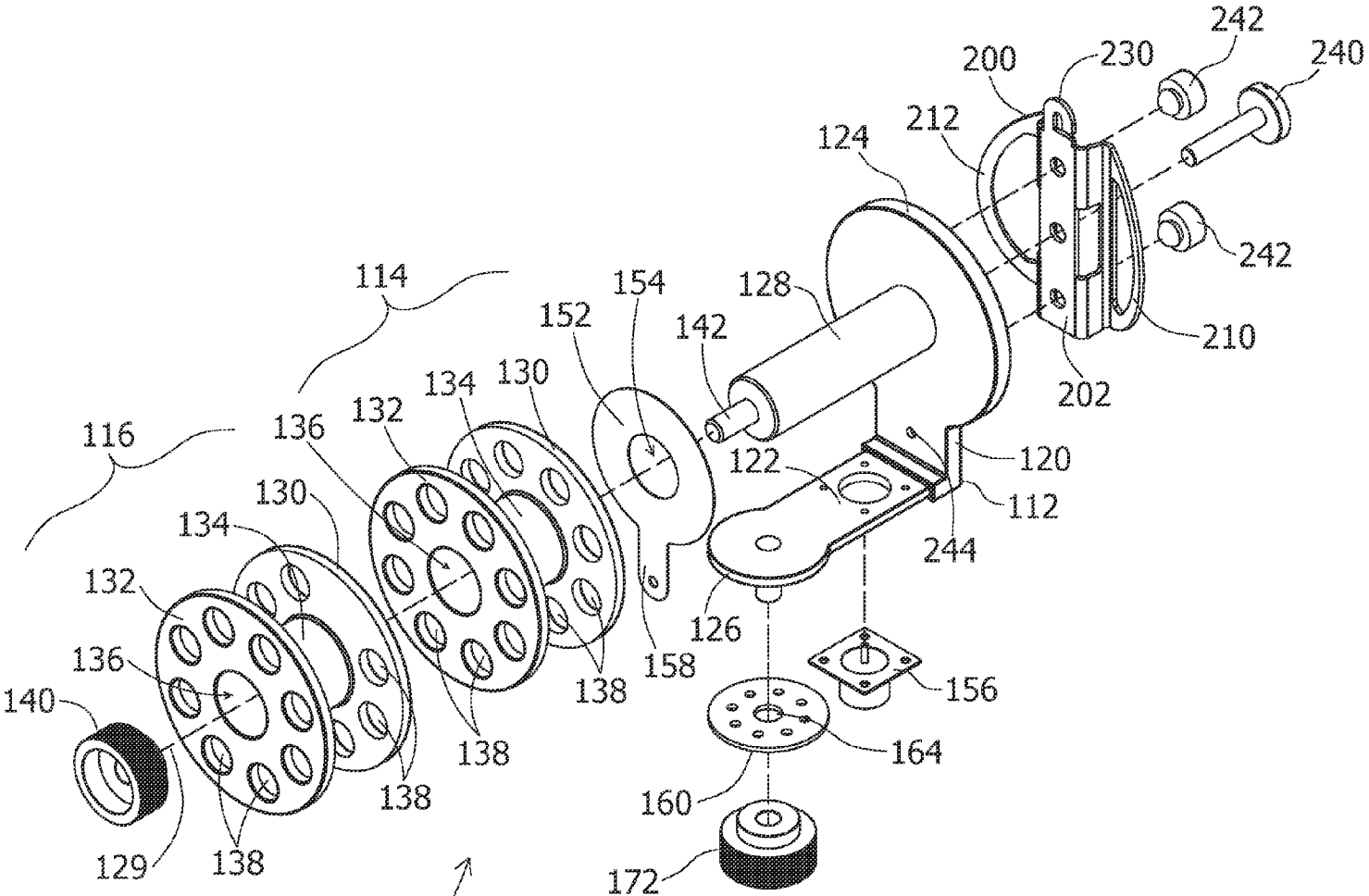
FIG. 3 is a forward exploded view illustrating the components of the antenna including the spindle frame, first and second rotatable spools and other conductive components for communicating signals.
Figure 4:
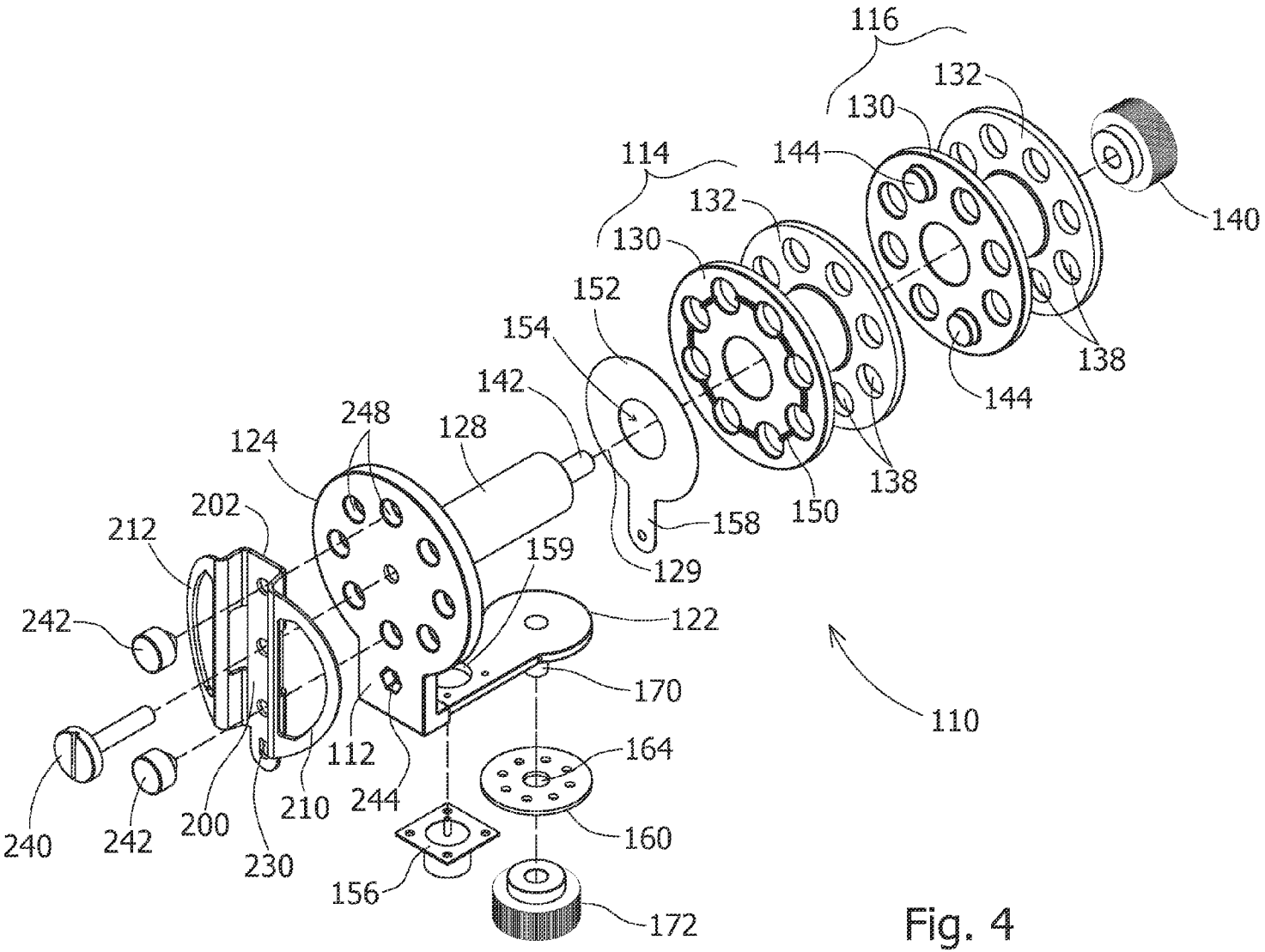
FIG. 4 is a rearward exploded view similar to FIG. 3.

Referring to FIGS. 2, 3, and 4, there is illustrated the spindle assembly 110 with the adjustable antenna cable and line removed. The primary structural components of the spindle assembly 110 can include a spindle frame 112 and a first spool 114 and a second spool 116 rotatably supported on the spindle frame that can accommodate the antenna cable and the non-conductive line. In the embodiment illustrated in FIGS. 2, 3, 4, 6 and 7, the spindle frame 112 is generally L-shaped and includes a first leg 120 and a second leg 122 that are generally oriented perpendicular to each other and extend orthogonally from their mutually joined ends. The first and second legs 120, 122 are generally flat and can preferably be made from any suitable material. For example, the second leg 122 can be formed from metal stock or bar and the first leg 120 can be a substantially plastic material attached to the second leg by an over-molding process. Hence, the plastic first leg 120 is non-conductive while the metallic second leg 122 can be conductive. As another example, the entire spindle frame 112 can be made from injection molded ABS (acrylonitride butadiene styrene) plastic or can be patterned from a sheet of such non-conductive material and bent into the L-shape via a heating and forming process. The distal end of the first leg 120 can have an enlarged first circular outline 124 and the distal end of the second leg 122 can have a smaller circular outline 126. In addition to the L-shape, in other embodiments, the spindle frame 112 may have other shapes and/or configurations including that of a straight bar or plate.

To support the first and second spools 114, 116, the spindle frame 112 includes a rod-like axle 128 that extends perpendicularly from the first leg 120 generally parallel to the second leg 122. Particularly, in the illustrated embodiment, the axle 128 extends from proximately the center of the first circular outline 124 of the first leg 120 so as to be spaced from the second leg 122. Accordingly, the axle 128 can define an axis line 129 perpendicular to the first leg 120 and parallel to the second leg 122 that serves as the axis of rotation for the first and second spools 114, 116 when mounted to the spindle frame 112. The rod-like axle 128 can have a smooth cylindrical surface and can be made from the same or a similar non-conductive material as the first leg 120 of the spindle frame 112.

Referring to FIGS. 2, 3, and 4, the first and second spools 114, 116 can be generally cylindrical in shape such that the antenna cable and/or the non-conductive line can be wound thereon. In particular, the first spool 114 and the second spool 116 are generally identical and can include a first circular flange 130, a spaced apart second circular flange 132 and a hub 134 extending between the first and second flanges. The hub 134 can be substantially smaller in diameter than the first and second circular flanges, which can be of substantially similar size. Disposed through and arranged radially around the first and second circular flanges 130, 132 can be a plurality of smaller circular apertures 138. The first and second spools 112, 114 can be made from any suitable, preferably non-conductive material. In a specific embodiment, the spools can be similar to or the same as the finger spools commonly used by underwater divers for handling ropes and lines.

To mount and demount the first and second spools 114, 116 to the spindle frame 112, there can be disposed through the hub 134 a cylindrical bore 136 that can slideably receive the rod-like axle 128. The bore 136 is oriented so that the first and second circular flanges 132, 134 are orthogonal to the axis line 129 when the spools 114, 116 are mounted to the spindle frame 112. In the illustrated embodiment, the first spool 114 and the second spool 116 are mounted axially adjacent to each other on the axle 128. In particular, the first spool 114 is mounted adjacent to the first leg 122 and the second spool 116 is mounted adjacent to the opposite side of the first spool and oriented toward the distal end of the axle 128. To enable rotation of the spools, the bore and the axle are dimensioned so that the spools are in sliding contact and can rotate with respect to the spindle frame similar to a journal bearing. To enable unobstructed rotation, the spools 114, 116 are spaced apart from and clear of the second leg 122 of the spindle frame 112. For securing and releasing the first and second spools 114, 116 to the spindle frame 112, an internally-threaded knob 140, larger in dimension than the bore 136, can be threaded onto a threaded rod 142 protruding from the distal end of the axle 128.

To provide the adjustable monopole antenna configuration depicted in FIG. 1, the conductive antenna cable can be wound about the first spool 114 and the non-conductive line can be wound about the second spool 116. In particular, referring to FIGS. 2, 3, and 4, the antenna cable can be a length of flexible wire that is successively wound around the hub 134 and constrained between the first and second flanges 120, 122. Likewise, the non-conductive line can be a length of string made from a material such as polyethylene that is similarly wound about the hub 134 of the second spool 116. As can be appreciated, when the first and second spools 114, 116 are rotated with respect to the axis line 129, the antenna cable and the non-conductive line can unwind and/or wind about the hubs 134 to pay out or take in length. Hence, the length or dimension that the antenna cable and/or non-conductive line extend from the spindle assembly can be adjusted to tune the antenna system to particular frequencies or wavelengths.

In one embodiment, to facilitate adjustable tuning, the first and second spools 114, 116 can be configured for selective dependent and independent rotation with respect to each other. To selectively couple the first and second spools 114, 116 together, as illustrated in FIG. 4, one or more plugs or prongs 144 can protrude from the first flange 130 of the second spool 116. The prongs 144 may be molded to the first flange 130 or, in other embodiments, may be press-fit or otherwise secured into one or more apertures 138 on the first flange. When the first flange 130 of the second spool 116 is adjacent to the second flange 132 of the first spool 114, the prongs 144 can be received in corresponding apertures 138 disposed into first spool, as generally indicated in FIGS. 2, 3, and 4. By coupling or clutching the first and second spools together in this manner, rotation of one spool will rotate the other spool, i.e., dependent rotation. If independent rotation is desired, the first and second spools 112, 114 can be axially separated from each other with respect to the axis line 129 to disengage the prongs 144 from the apertures 138. Threading or unthreading the knob 140 can assist in adjusting the axial spacing between the first and second spools 114, 116 with respect to each other and the axis line 129.

Furthermore, the first and second spools can be counter-wound with respect to each other. For instance, the antenna cable can be wound in a clockwise direction on the first spool 114 and the non-conductive line can be wound in a counter-clockwise direction on the second spool 116. When the first and second spools 114, 116 are rotated dependently in the same direction, for example, clockwise, the first spool will wind in the antenna cable while the second spool will unwind or payout the non-conductive line. Rotation counter-clockwise will produce the opposite effect. Referring back to FIG. 1, dependent rotation in this manner allows adjustment of the respective lengths between the antenna cable 102 and the non-conductive line 106 without significant resetting of the antenna system. For example, if the fixed height of the vertically arranged antenna system 100 is indicated by bracket 108, dependent rotation of the spools will adjust the effective height of the conductive antenna cable 102 while winding or unwinding a corresponding amount of the non-conductive line 106. Accordingly, the overall height 108 of the antenna system remains fixed while the effective or operational length of the antenna cable changes in order to tune to a particular frequency. If adjustment of the overall fixed height 108 is desired, the first and second spools can be disengaged for independent rotation to simultaneously wind-out or wind-in the antenna cable and non-conductive line.

Because the spools can be mounted and demounted to the spindle frame, it is possible to arrange the spools so that they can be counter-wound in opposite directions with respect to each other or, alternatively, wound in the same direction as each other. Winding the spools in the same direction as each other enables the antenna cable and non-conductive line to wind or unwind in conjunction with each other such as, for example, when setting up or breaking down the antenna system. Additionally, if desired, one or both of the spools can be demounted from the spindle frame and independently wound by hand. Further, different spools can be provided with different thickness or materials of antenna cable to achieve different transmission characteristics. Additionally, different thicknesses and materials of antenna cable can be selected for aesthetic purposes such as reducing visibility of the antenna.

To communicate a signal between the antenna cable and an associated receiver or transmitter, the antenna system can include a conductive communications bus adapted to carry electrical signals. Referring to FIG. 4, a conductive contact 150 can be disposed on the outer surface of the first flange 130 of the first spool 114 and can be in electrical communication with the antenna cable that is ordinarily wound about the first spool. In a particular embodiment, the contact 150 can be formed by directing a portion of the cable antenna through several of the apertures 138 disposed through the first flange 130 so that the portion of the cable antenna is exposed on the outer surface of the first flange. In other embodiments, the cable antenna can be connected to a plate or bar on the outside of the first flange 130 to form the contact 150 or the contact can be molded as part of the first spool itself. Additionally, the spool itself can be conductive.

Figure 5:
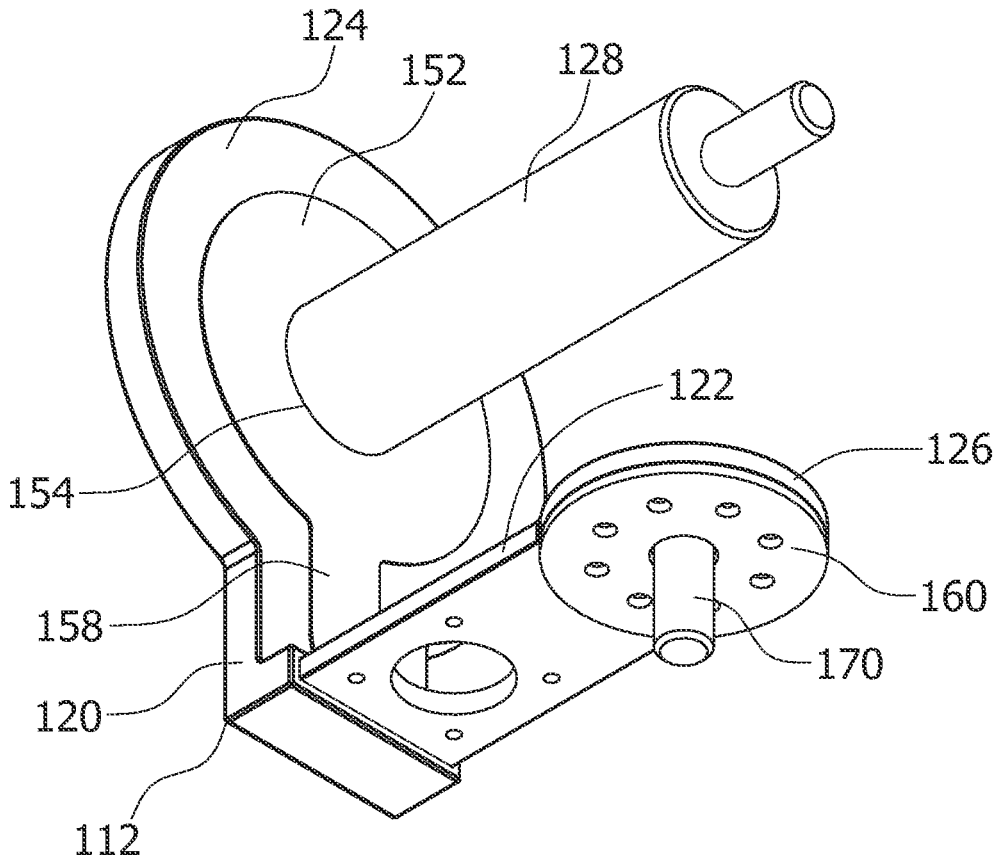
FIG. 5 is a perspective view of the spindle frame with the first and second spools removed and showing the conductive components disposed on the spindle frame.
Figure 6:
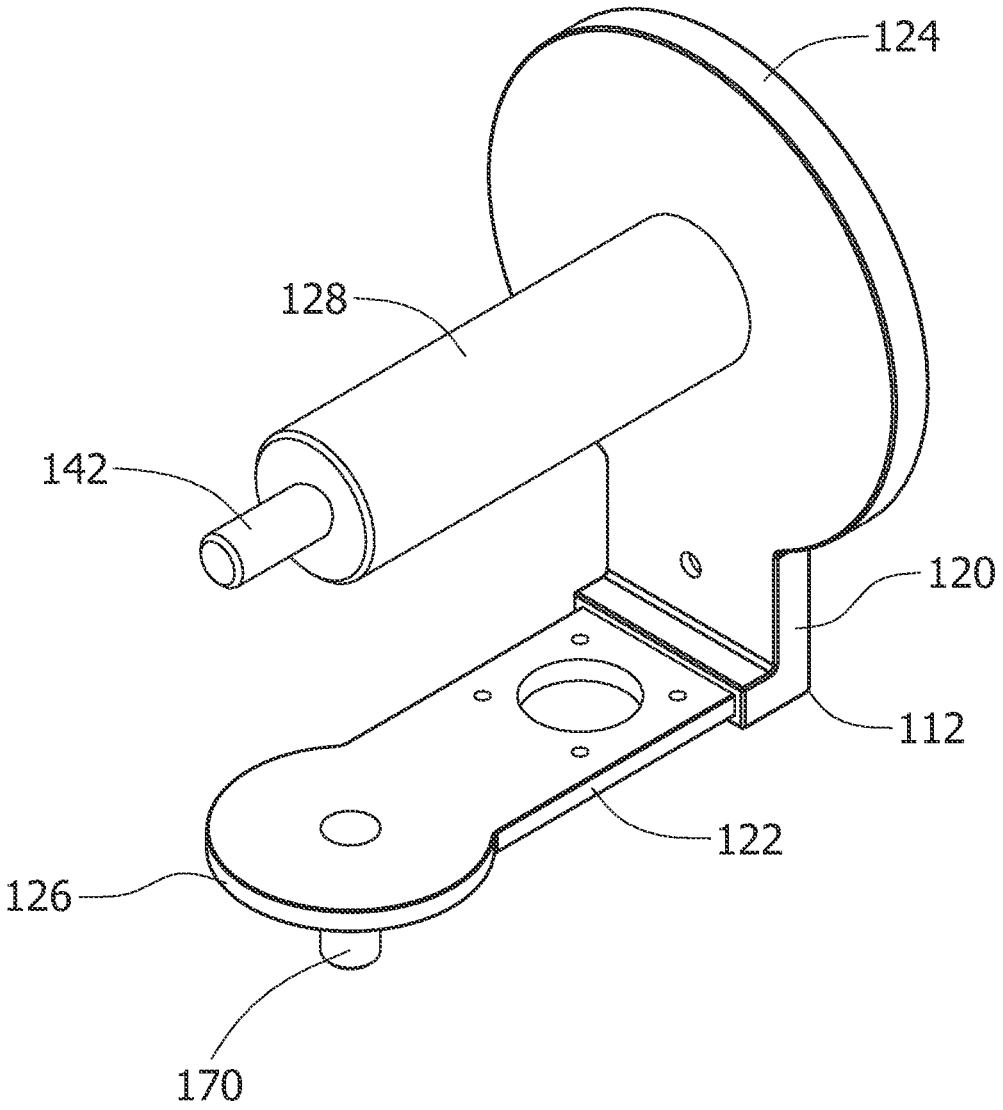
FIG. 6 is a top, front perspective view of the spindle frame with the conductive components removed.
Figure 7:
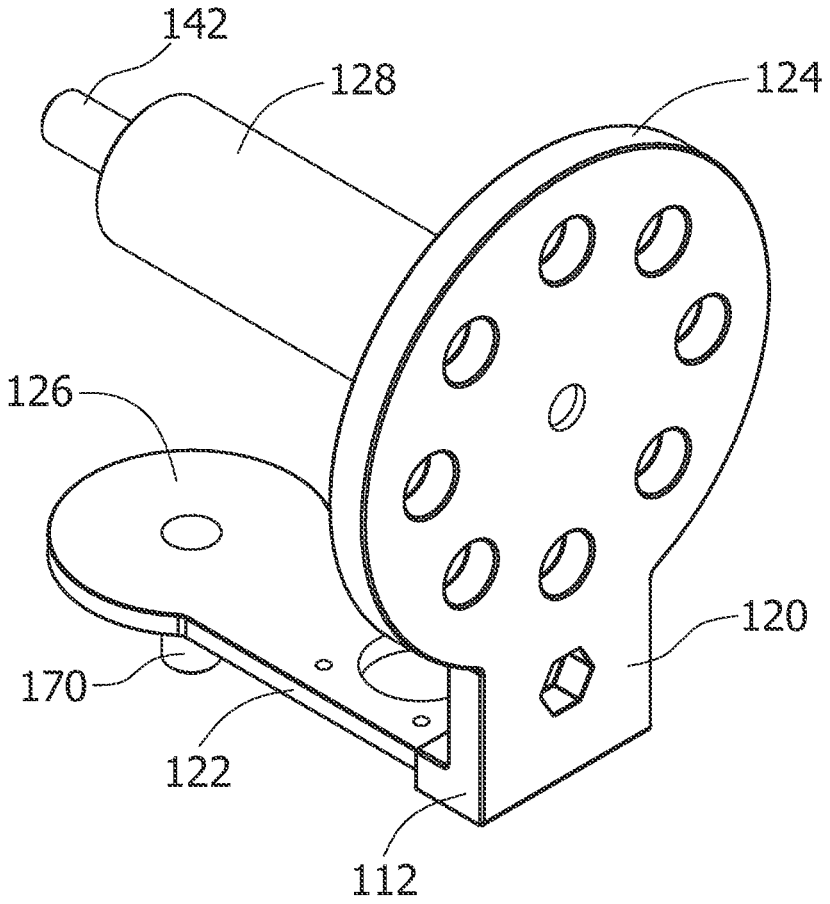
FIG. 7 is a top, rear perspective view of the spindle frame similar to FIG. 6.

Referring to FIGS. 3, 4, and 5, to communicate with the contact, there can be disposed onto the first leg 120 of the spindle frame 112 a conductive slip ring or slip plate 152. The slip plate 152 can be made from thin, stainless steel or possibly malleable metal sheet such as spring steel and is disposed on the enlarged circular outline 124 and around the protruding axle 128 that may extend through an opening 154 in the slip plate. To superimpose the slip plate 152 onto the first circular outline 124 of the first leg 120, the slip plate 152 itself can have a circular outline. As will be appreciated from FIGS. 2, 3, and 4, when the first spool 114 is axially adjacent to the first leg 120, and more specifically when the first flange 130 is adjacent to the first circular outline 124, the contact 150 and the slip plate 152 will make a sliding electrical connection with each other. Hence, whenever the spools are rotated the contact 150 and slip plate 152 can remain in communication. To urge the contact 150 and slip plate 152 into electrical contact, the knob 140 can be tightened down onto the axle 128 displacing the spools 114, 116 toward the first leg 120.

To communicate the signals from the spindle assembly 110 to a receiver/transmitter associated with the antenna system 100, a connector 156 such as a coaxial connector can be disposed on the underside of the second leg 122. Communication between the slip plate 152 and the connector 156 can be established by a transmission channel or transmission bus 158 disposed along the spindle frame 112. In the illustrated embodiment, the transmission bus 158 can be an integral portion of the slip plate 152 that depends along the first leg 120 and can connect with a wire directed through a hole 159 disposed through the second leg 122. The connector can be partially disposed in the hole 159 on opposite side of the second leg and can connect to the wire leading from the transmission bus 15. In other embodiments communication between the transmission bus 158 and the connector 156 can be established via contacts, pins or leads otherwise disposed through the second leg 122. For example, the transmission bus 158 can connect with the central or main lead of a coaxial connector. A coaxial cable connected to the connector 156 can complete the signal transmission to and from the receiver/transmitter.

Figure 8:
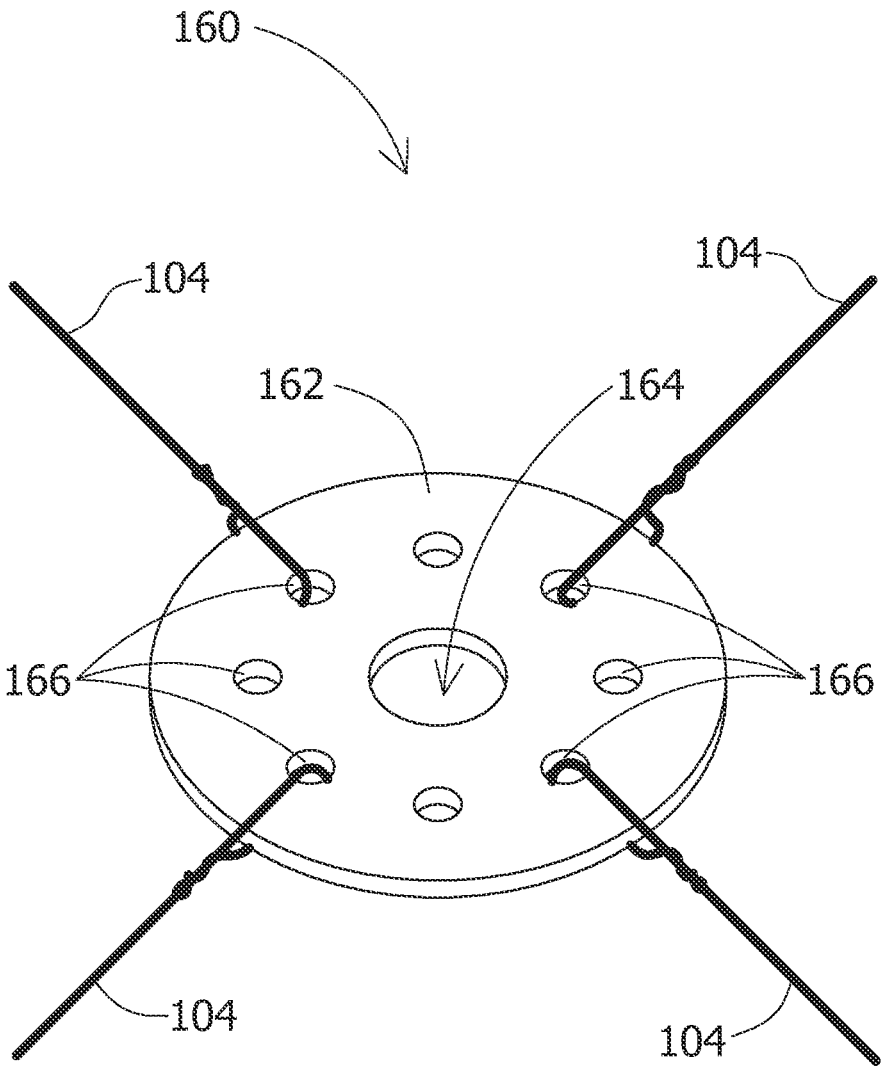
FIG. 8 is a top perspective view of a radial unit for attaching a plurality of conductive radials to the underside of the spindle frame.
Figure 8A:
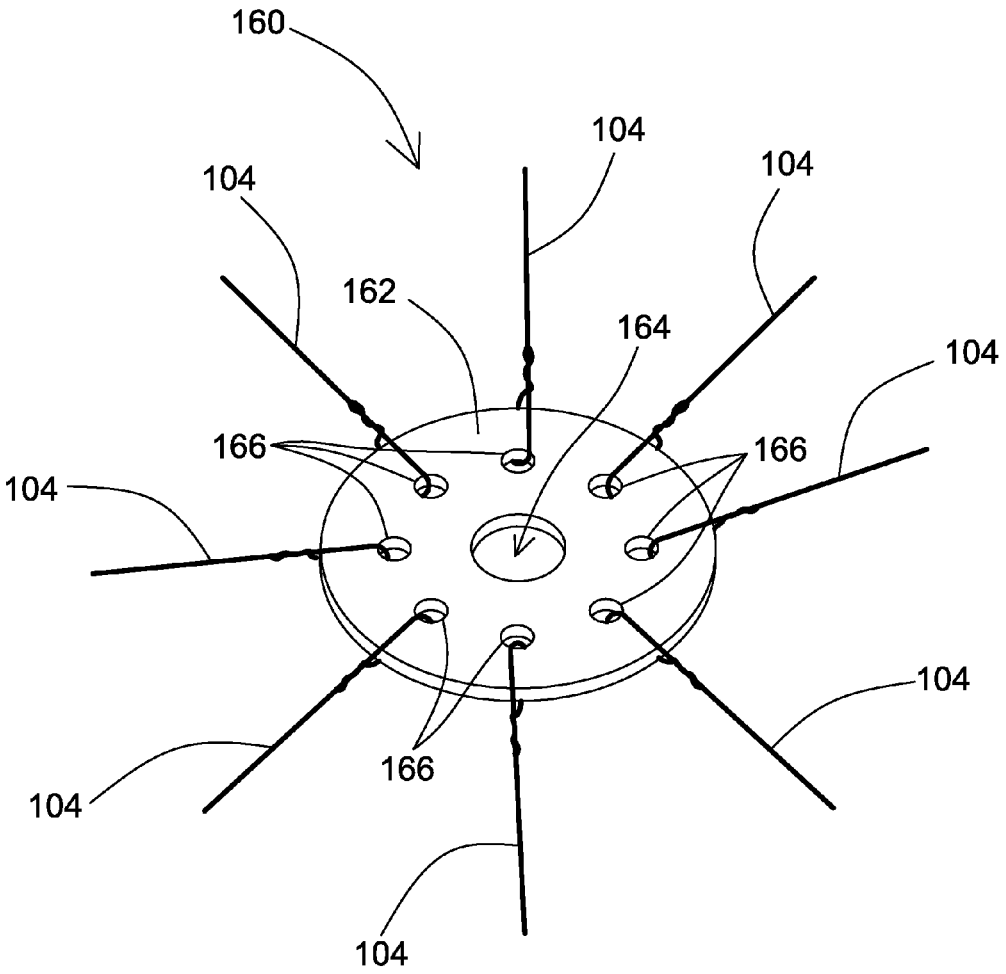
FIG. 8*a* is a top perspective view of another embodiment of a radial unit having eight radials.

In the embodiment where the antenna system 100 is configured as vertical monopole antenna, the antenna system can include a radial unit 160 for establishing an elevated radial ground plane or counterpoise as depicted in FIG. 1. Referring to FIG. 8, the radial unit 160 can include a conductive disc 162 that may be generally flat and circular. In the specific embodiment, the conductive disc 162 can be an annular metal washer with a central hole 164 and a plurality of radially disposed apertures 166 generally proximate to the periphery of the disc. Radials 104, in the form of thin, flexible, conductive wires, can be directed through each of the apertures 166 with one end tied thereabout so that the remainder of the radial can extend away from the conductive disc 162. Although only four radials are shown in the illustrated embodiment, it will be appreciated that in other embodiments any suitable number of radials may be included, such as the eight radials shown in FIG. 8*a*. In one advantageous embodiment, the lengths of the radials 104 can be simply adjusted by manipulatively looping an undesired length of the radial back through the apertures so that only the desired length extends from the conductive disc 162. It will be appreciated that in this embodiment the point where the radial 104 passes through the aperture 166 will be in short circuit contact with the conductive disc 162. In the illustrated embodiment, eight radials 104 are included but in other embodiments any suitable number of radials can be used.

To attach the radial unit 160 to the spindle frame 112, referring to FIGS. 3, 4, and 5, the spindle frame can include a threaded rod 170 depending from the distal end of the second leg 122 and generally concentric with the second circular outline 126. The radial unit 160 can be placed flat against and adjacent to the underside of the second leg 122 with the threaded rod 170 protruding through the central hole 164 of the radial unit. A second, internally threaded knob 172 can be threaded onto the threaded rod 164 to releasably secure the radial unit 160 to the underside of the second leg 122. When the knob 172 is tightened onto the threaded rod 170, the radials can be securely clamped between the conductive disc of the radial unit 160 and the second leg 122 ensuring good electrical connection. One possible advantage of this attachment configuration is that various different radial units having different numbers and/or lengths of radials can be interchangeably attached for use with the antenna system.

Referring to FIGS. 2-5, in the embodiment in which the second leg 122 is metallic, attaching the radial unit 160 to the underside of the second leg can establish signal communication between the radial unit and the connector 156 also disposed on the underside of the second leg. As a specific example, the radial unit 160 may connect with the grounding or shielding unit of a coaxial connector 156. A possible advantage of this design is that all radials are connected through a single or common point of communication or loading via the radial unit by which the radials are connected using a single fastener. In other embodiments in which the second leg 122 is made of a non-conductive material, a second conductive transmission bus, for example, formed from sheet metal, can be disposed along the underside of the second leg from the second circular outline 126 to a location proximate where the connector 156 is joined to the spindle frame 112. The conductive second transmission bus can therefore establish communication between the radial unit 160 mounted to the spindle frame 112 and the connector 156.

Referring back to FIGS. 1 and 2, and as mentioned earlier, in an alternative embodiment, the antenna system 100 can be configured to operate as a dipole antenna. To do so, the second spool 116 is also wound with conductive antenna cable rather than non-conductive line. Accordingly, two lengths of conductive cable can extend from the spindle assembly 110 each of which can function as one-half of a dipole antenna. In such an embodiment, the two lengths of conductive cable do not need to be connected together at their extremities as depicted in FIG. 1. Additionally, the two lengths of cable can extend from the spindle assembly 110 in opposite directions, either horizontally or vertically, to optimize the radiation and transmission patterns, in which case the cables may be wound on the spools in the same direction to facilitate extension and retraction of the cables by rotating the spools in a common direction. In the dipole antenna embodiment, it will be recognized that the radials that form the ground plane or counterpoise may not be necessary.

Figure 9:
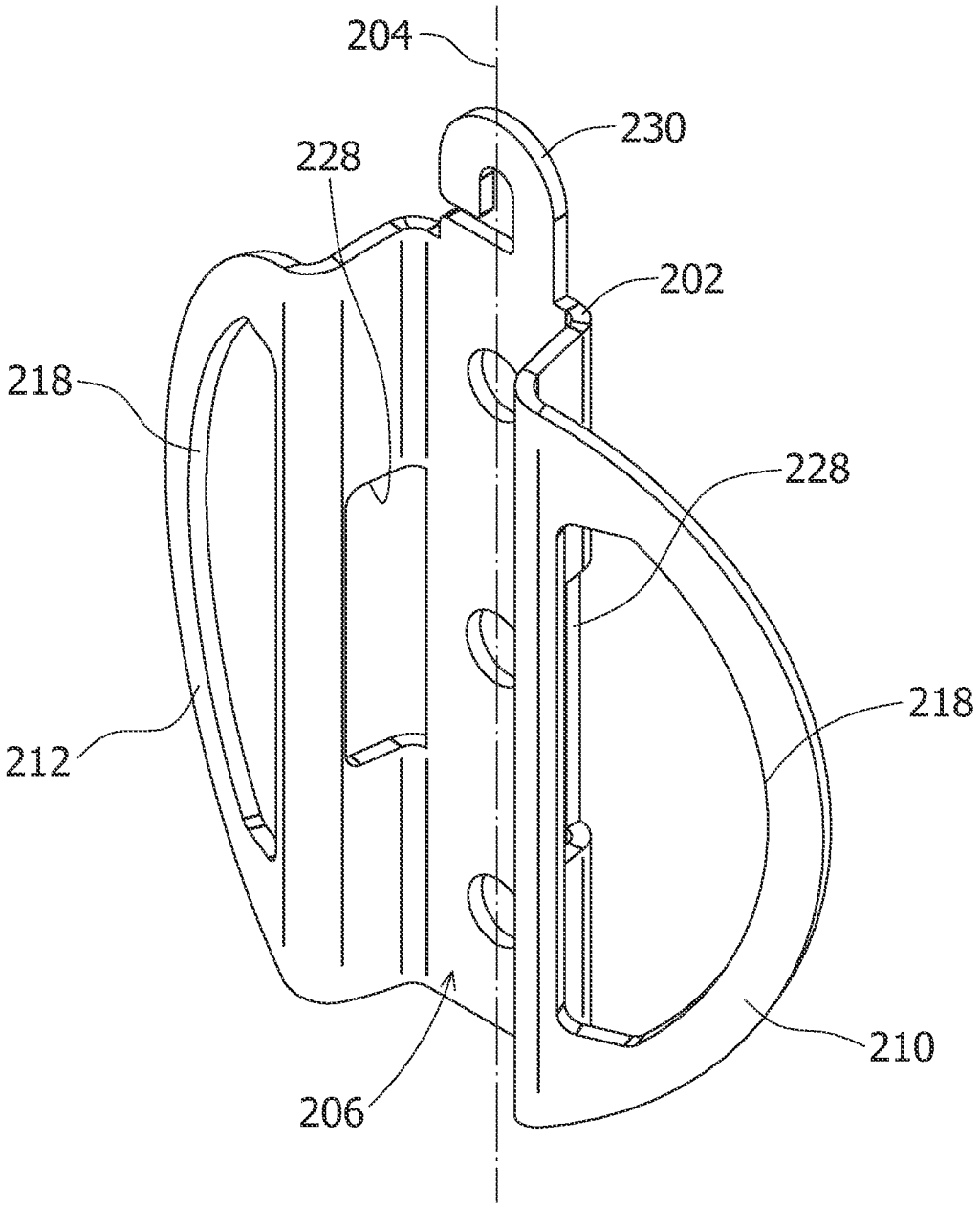
FIG. 9 is a perspective view of a clamp for attachment to the spindle frame for clamping the antenna system to various fixtures.
Figure 10:
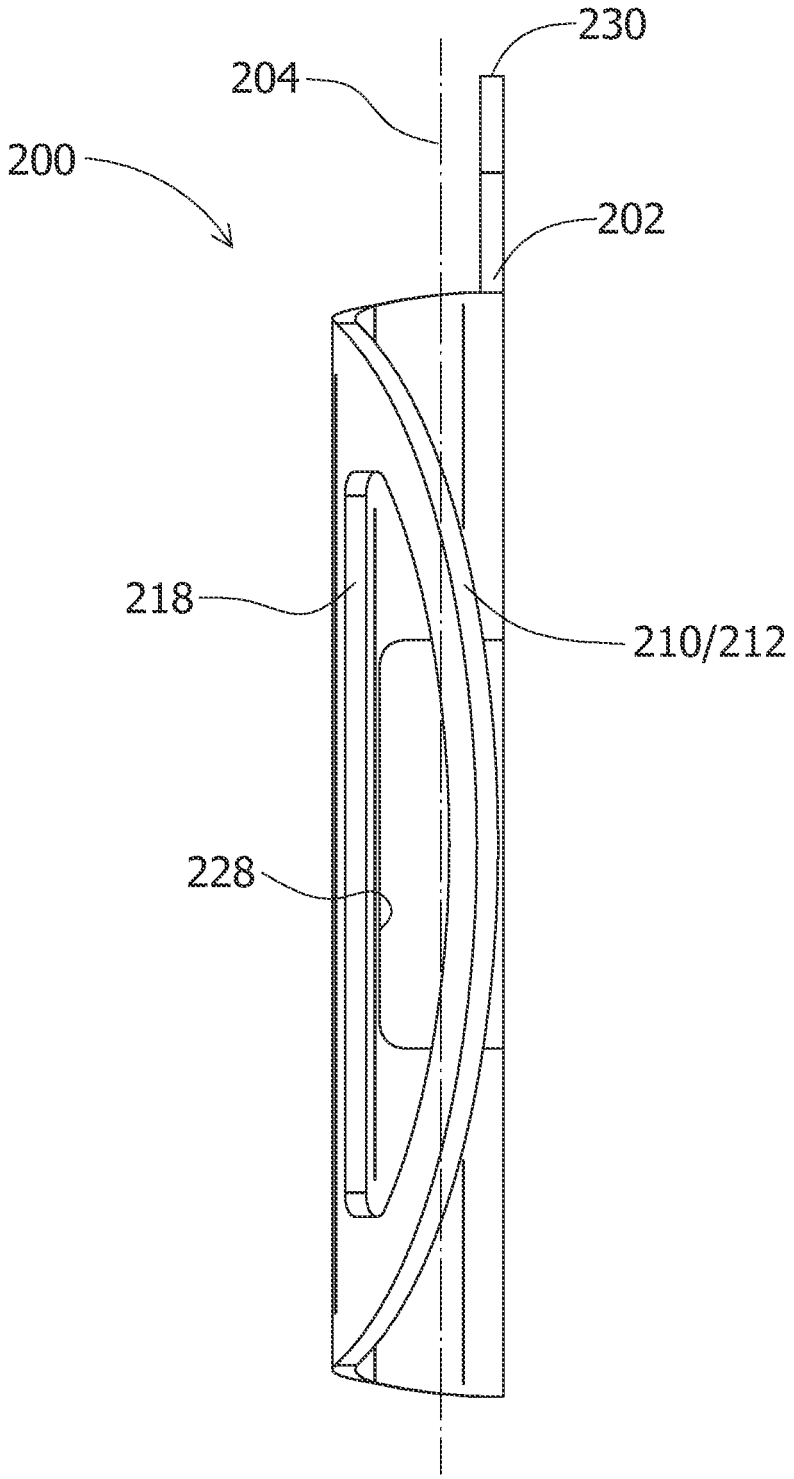
FIG. 10 is a side plane view of the clamp of FIG. 9.
Figure 11:
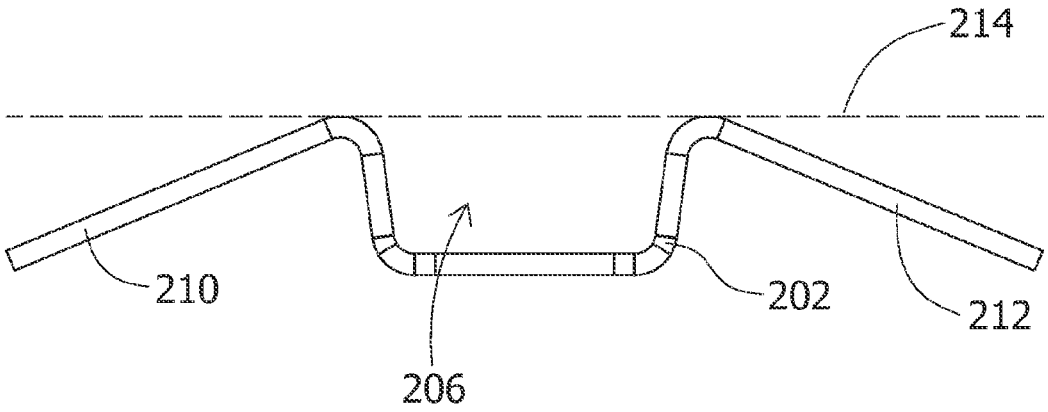
FIG. 11 is an elevational view of the clamp of FIGS. 9 and 10.

Referring to FIGS. 9, 10 and 11, in a further embodiment, there can be provided a clamp 200 that is attachable to the first leg and that can be configured for attaching the spindle frame to a fixture and/or strapping the spindle frame to a fixture. The clamp 200 can be attached to the exterior of the first leg opposite the side from which the axle extends. To form the clamp, a blank can be formed by stamping or laser cutting sheet metal and bending it into the illustrated configuration. The clamp can include a centrally orientated spine 202 which may define a central axis 204 of the clamp. The spine 202 can have a U-shaped or C-shape cross-section that delineates a central channel 206 that extends along the central axis 204. Extending in opposite directions from the opposing legs of the U-shaped spine 202 and away from the central axis 204 can be first and second, semi-circular wings 210, 212. Referring to FIG. 11, the first and second wings 210, 212 can be partially sweptback so that they depend away from a horizontal plane 214 defined through the joints at which the spine 202 and wings meet. Disposed through and outlined by each of the first and second wings 210, 212 can be a semi-circular aperture 218. The clamp 200 can also include two horizontal, elongated slots 228 that are disposed generally in the joints between the spine 202 and the wings 210, 212. Referring to FIG. 10, due to the partially sweptback orientation of the wings 210, 212, the slots 228 can align with the semi-circular apertures 218 in each of the wings when viewed from a side elevational orientation. In the illustrated embodiment, the clamp 200 can also include a hook 230, for example, a J-shaped hook, at one of the distal ends of the spine 202 and that extends in a direction generally aligned with the central axis 204. In some embodiments, a second hook can be included at the opposite distal end of the spine.

The clamp 200 can function to mount the antenna system to a fixture in a variety of ways. For example, referring to FIGS. 3 and 4, the clamp 200 can be attached to the spindle frame 112 so that the spine 202 is adjacent to and vertically aligned with the first leg 120 and the first and second wings 210, 212 depend toward the first leg. A threaded fastener 240 can secure the clamp 200 generally concentrically to the first circular outline 124 of the first leg 120. The attached clamp 200 can be placed adjacent to a vertical post such that the post is partially received in the U-shaped channel of the spine 202. A flexible belt, such as one made from canvas or a polymeric web, can be directed through the apertures 218 in the wings and the aligned slots 228 in the spine 202 to strap the clamp 200 and thus the spindle assembly 110 to the post. In this embodiment, one or more elastomeric grommets 242 can be press-fit into holes disposed through the spine 202 to assist in mounting the clamp 200 to the post.

The clamp 200 can perform additional functions. For example, referring to FIG. 3, in which the hook 230 is oriented vertically upwards, the hook can extend beyond the periphery delineated by the circular outline 124 of the first leg 120. In this orientation, the antenna cable and/or the non-conductive line can be hooked under the hook 230 to suspend the spindle assembly from the cable/line or to help feed out the cable/line during adjustment. Alternatively, the clamp 200 can be used to secure one or more additional antenna elements to the spindle assembly 110 to improve the transmission and/or reception capabilities. Specifically, as illustrated in FIG. 4, the clamp 200 can be spun around with respect to the second leg 120 so that the hook 230 is directed downward. The hook 230 may align with an aperture 244 disposed through the first leg 120 so that the hook can be placed in electrical contact with the transmission bus 158 disposed on the opposite side of the first leg by, for example, a screw or a pin projecting through the aperture 244. Accordingly, the clamp 200 may be energized or made an active element communicating with the connector 156. Further, the additional antenna elements, which may have a rod-like shape or base, can be accommodated between the depending wings 210, 212 of the clamp 200 and the first circular outline 124 of the first leg 120. Accordingly, the additional antenna elements can be placed in communication with the connector 156 through the hook 230 and the transmission bus 158. In another embodiment, the bracket can include one or more indexing pins, which may be the rubber grommets 242, that protrude from the spine 202 of the clamp. The indexing pins can mate with indexing apertures 248 disposed around the circular outline on the first leg. In use, the clamp can be rotated with respect to the circular outline and the indexing pins can mate with the indexing apertures 248 to fix the clamp in different orientations to further facilitate mounting of the antenna system. Accordingly, the clamp 200 can be reoriented in various degrees with respect to the second leg so the spindle assembly 110 can be attached in various orientations, for example, to a horizontal tree branch or the like.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A motorless adjustable antenna system comprising:

a spindle frame including a first leg and a rod-like axle extending from the first leg;

a first spool rotatably and readily mountable and demountable on and rotatably slidable with respect to the axle to be adjacent to the first leg, the first spool having wound thereon a conductive antenna cable; and a second spool rotatably readily mountable and demountable on and rotatably slidable with respect to the axle to be adjacent to the first spool, the second spool having wound thereon a non-conductive line.

2. The motorless adjustable antenna system of claim 1, wherein the spindle frame is L-shaped and includes a second leg extending generally perpendicularly from the first leg and generally parallel to the axle.

3. The motoroless adjustable antenna system of claim 2, wherein the first spool and the second spool each have a first circular flange, a spaced-apart second circular flange and a hub extending between the first and second flange, wherein the antenna cable and/or line is wound around the hub.

4. The motorless adjustable antenna system of claim 3, wherein the first spool and the second spool each include a bore disposed through the hub to slidably receive the axle when mounted to the spindle frame.

5. The motorless adjustable antenna system of claim 4, wherein the first spool and the second spool are selectively coupled for selective dependent and independent rotation with respect to each other.

6. The motorless adjustable antenna system of claim 5, further comprising a knob threadably attachable to the distal end of the axle for securing and releasing the readily mountable and demountable first and second spools.

7. The motorless adjustable antenna system of claim 5, wherein the first circular flange and the second circular flange of the first and second spools each has dispose therein a plurality of radially arranged apertures.

8. the motorless adjustable antenna system of claim 7, wherein at least one of the first and second spools includes a prong protruding from at least one of the first circular flange and the second circular flange, the prong receivable in one of the plurality of radially arranged apertures for selective coupling and decoupling of the first spool and the second spool.

9. The motorless adjustable antenna system of claim 2, wherein the first spool includes a contact exposed on an outer surface of the first flange, the contact in electrical communication with the antenna cable.

10. The motorless adjustable antenna system of claim 9, further comprising a slip plate disposed on the first leg to electrically communicate with the contact.

11. The motorless adjustable antenna system of claim 10, wherein the slip plate communicates with a connector disposed on the second leg via a transmission bus partially disposed on the spindle frame.

12. The motorless adjustable antenna system of claim 2, further comprising a radial unit including a plurality of conductive radials extending therefrom, the radial unit attachable to the second leg of the spindle frame.

13. The motorless adjustable antenna system of claim 12, wherein the radial unit includes a conductive disc having a plurality of apertures disposed therein proximate the periphery of the disc, the plurality of radials each direct through a corresponding aperture to secure the radial to the disc.

14. The motorless adjustable antenna system of claim 13, wherein a length of each radial is adjusted by pulling a portion of the radial through the respective aperture.

15. The motorless adjustable antenna system of claim 14, further comprising a plurality of radial units each including a different plurality of radials, the plurality of radial units interchangeably attachable to the second leg of the spindle frame.

16. The motorless adjustable antenna system of claim 1, further comprising a clamp attachable to first leg, the clamp configured for bolting the support frame to a fixture and/or strapping the spindle frame to a fixture.

17. The motorless adjustable antenna system of claim 16, wherein the clamp includes a spine, a first wing and a second wing extending from and partially sweptback with respect to the spine, the first and second wings including apertures for receiving a belt for strapping the support frame to a fixture.

18. The motorless adjustable antenna system of claim 2, wherein the spindle frame is produced by an overmolding process such that the second leg is exposed metal and the first leg is non-conductive.

* * * * *